US008422916B2

(12) United States Patent
Lee

(10) Patent No.: US 8,422,916 B2
(45) Date of Patent: Apr. 16, 2013

(54) CHARGE DEVICE AND IMAGE FORMING APPARATUS HAVING THE SAME

(75) Inventor: Won Wook Lee, Seoul (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 116 days.

(21) Appl. No.: 12/969,787

(22) Filed: Dec. 16, 2010

(65) Prior Publication Data

US 2011/0158693 A1 Jun. 30, 2011

(30) Foreign Application Priority Data

Dec. 24, 2009 (KR) ..... 10-2009-0131148

(51) Int. Cl.
*G03G 15/02* (2006.01)

(52) U.S. Cl.
USPC ..... 399/168

(58) Field of Classification Search ..... 399/168, 399/170

See application file for complete search history.

(56) References Cited

U.S. PATENT DOCUMENTS

2003/0190171 A1* 10/2003 Yuge ..... 399/100
2009/0269105 A1* 10/2009 Hano ..... 399/171
2010/0196050 A1* 8/2010 Iwamatsu et al. ..... 399/168

* cited by examiner

*Primary Examiner* — Walter L Lindsay, Jr.
*Assistant Examiner* — Frederick Wenderoth
(74) *Attorney, Agent, or Firm* — Stanzione & Kim, LLP

(57) ABSTRACT

A charge device including an electrode arranged to face an object to be charged, and an image forming apparatus having the same. The electrode includes an electrode body made of a conductive material, a first layer made of carbon and formed on an outer surface of the electrode body, and a second layer made of a metal and formed between the electrode body and the first layer, to reduce and/or impede oxidization thereof.

22 Claims, 4 Drawing Sheets

CHARGE DEVICE AND IMAGE FORMING APPARATUS HAVING THE SAME

CROSS-REFERENCE TO RELATED APPLICATIONS

This application claims priority under 35 U.S.C. §119(a) from Korean Patent Application No. 2009-0131148, filed on Dec. 24, 2009 in the Korean Intellectual Property Office, the disclosure of which is incorporated herein in its entirety by reference.

BACKGROUND

1. Field of the Invention

Embodiments of the present general inventive concept relate to an image forming apparatus having a charge device to charge a photoconductor.

2. Description of the Related Art

Generally, image forming apparatuses are devised to form an image on a printing medium according to input image signals. Examples of image forming apparatuses include printers, copiers, fax machines, and devices combining functions thereof.

An image forming apparatus may include, e.g., a body defining an external appearance of the image forming apparatus, a developing unit to attach developer to an electrostatic latent image to form a visible image, an exposure unit to form an electrostatic latent image on a charged photoconductor of the developing unit, a fusing unit to fuse developer transferred to a printing medium, a printing medium supply unit to supply a printing medium to a transfer device, and a printing medium discharge unit to discharge a printing medium, on which an image has been completely formed, to the outside of the body.

In operation of the image forming apparatus, after the exposure unit scans light to the charged photoconductor of the developing unit to form an electrostatic latent image on a surface of the photoconductor, developer is fed to develop the electrostatic latent image into a visible image. Subsequently, the transfer device transfers the visible image from the photoconductor to a printing medium supplied from the printing medium supply unit and the fusing unit fuses the transferred image to the printing medium to complete image formation on the printing medium. The resulting printing medium is discharged to the outside of the body by the printing medium discharge unit.

The developing unit includes a charge device to charge the photoconductor with a predetermined potential as described above. The charge device includes first and second electrodes spaced apart from each other to perform corona discharge therebetween, thereby serving to charge the photoconductor with a predetermined potential.

During corona discharge between the first electrode and the second electrode, byproducts of corona discharge, such as ozone, nitrogen oxide, nitrogen dioxide, etc., are generated in the charge device. Over time, these byproducts of corona discharge may oxidize or contaminate the electrodes, preventing the charge device from uniformly charging the surface of the photoconductor and resulting in image defects.

SUMMARY

The present general inventive concept can provide a charge device to stably charge a photoconductor over time and an image forming apparatus having the same.

Additional features and utilities of the present general inventive concept will be set forth in part in the description which follows and, in part, will be obvious from the description, or may be learned by practice of the present general inventive concept.

Exemplary embodiments of the present general inventive concept can provide a charge device that includes a lattice-shaped electrode arranged to face an object to be charged, where the lattice-shaped electrode includes an electrode body made of a conductive material, a first layer made of carbon and formed on an outer surface of the electrode body, and a second layer provided between the electrode body and the first layer.

The second layer may be made of a metal having greater corrosion resistance than the electrode body.

The second layer may be made of any one of chromium, titanium, and tungsten.

Exemplary embodiments of the present general inventive concept may also provide, a charge device that includes a first electrode having a first surface arranged to face an object to be charged, and a second electrode spaced apart from an opposite second surface of the first electrode, where the first electrode includes an electrode body made of a conductive material, a first layer made of carbon and formed on an outer surface of the electrode body, and a second layer provided between the electrode body and the first layer.

The electrode body may be made of stainless steel.

The first electrode may include a lattice-shaped electrode.

The second electrode may include a pin-shaped electrode having a pointed end.

Exemplary embodiments of the present general inventive concept may also provide an image forming apparatus that includes a photoconductor, and a charge device to charge the photoconductor, where the charge device includes a first electrode having a first surface arranged to face the photoconductor, and a second electrode spaced apart from an opposite second surface of the first electrode, and the first electrode includes an electrode body made of a conductive material, a first layer made of carbon and formed on an outer surface of the electrode body, and a second layer provided between the electrode body and the first layer.

Exemplary embodiments of the present general inventive concept may also provide a developing unit of an image forming apparatus to form developer images onto an imaging medium, including a photoconductor having a surface on which an electrostatic latent image is formed, a developing member to develop the electrostatic latent image on the photoconductor into a visible image with developer, and a charge device to charge the surface of the photoconductor with a predetermined potential before an exposure unit forms the electrostatic latent image on the surface of the photoconductor, the charge device having a first electrode with a first surface arranged to face the photoconductor, and a second electrode spaced apart from an opposite second surface of the first electrode.

The first electrode of the developing unit can include an electrode body made of a conductive material, a first layer made of carbon and formed on an outer surface of the electrode body, and a second layer provided between the electrode body and the first layer.

The second layer of the developing unit can have a greater corrosion resistance than the electrode body.

Exemplary embodiments of the present general inventive concept may also provide a charge device, including an electrode arranged to face an object to be charged, the electrode having an electrode body formed a conductive material, a first layer disposed on a surface of the electrode body, and a second layer made of carbon disposed on a surface of the first layer.

The electrode body of the charge device may be stainless steel.

The second layer of the charge device can be a layer to protect the electrode body from discharge byproducts.

The second layer of the charge device can include one of chromium, titanium, and tungsten.

BRIEF DESCRIPTION OF THE DRAWINGS

These and/or other utilities of the present general inventive concept will become apparent and more readily appreciated from the following description of the embodiments, taken in conjunction with the accompanying drawings of which.

DETAILED DESCRIPTION OF THE EMBODIMENTS

Figure 1:
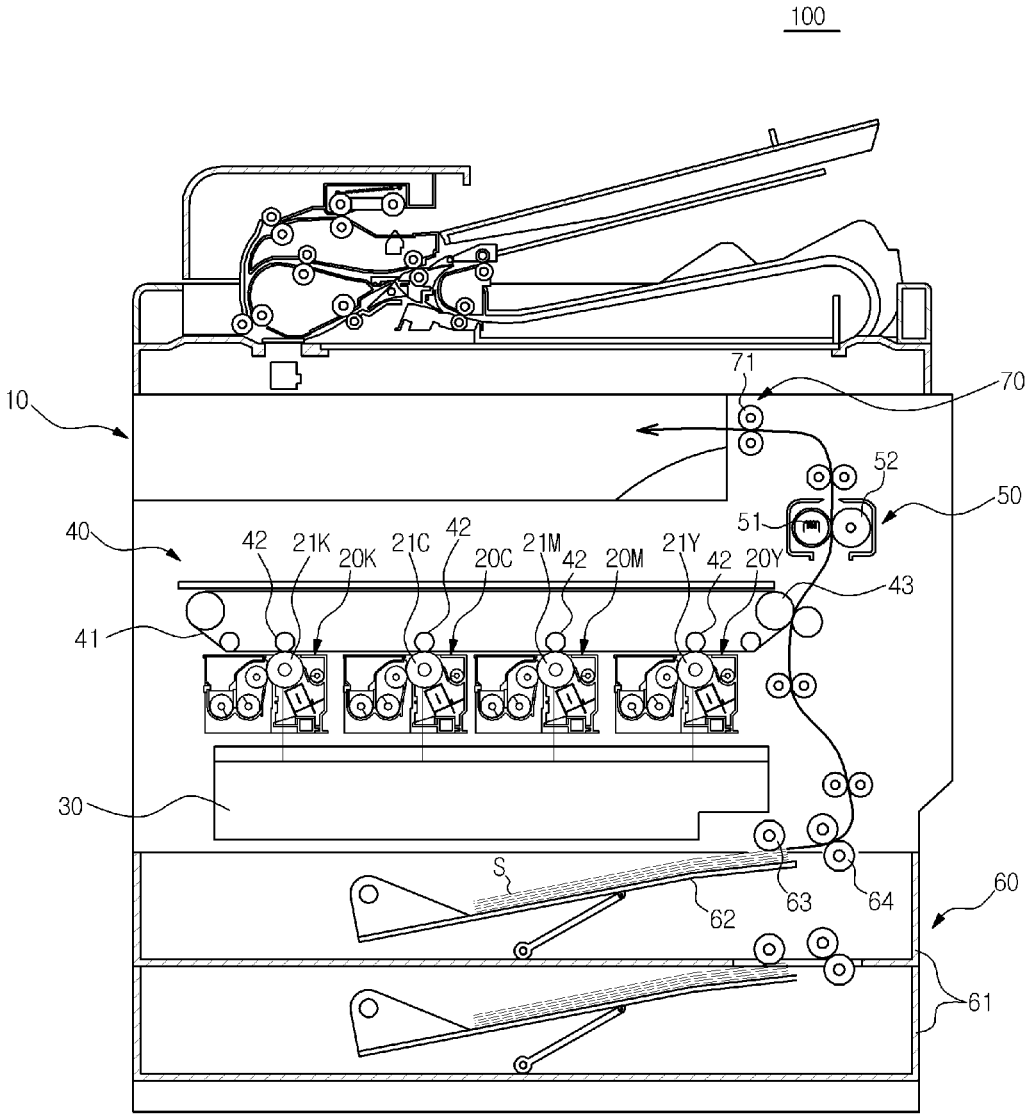
FIG. 1 illustrates a sectional view of an image forming apparatus according to exemplary embodiments of the present general inventive concept.

Reference will now be made in detail to the embodiments of the present invention, examples of which are illustrated in the accompanying drawings, wherein like reference numerals refer to like elements throughout. The embodiments are described below in order to explain the present general inventive concept by referring to the figures.

Hereinafter, an image forming apparatus according to exemplary embodiments of the present general inventive concept will be described in detail with reference to the accompanying drawings.

As illustrated in FIG. 1, the image forming apparatus 100 includes a body 10 to define an external appearance of the image forming apparatus, a plurality of developing units 20K, 20C, 20M and 20Y to develop an electrostatic latent image into a visible image using developer, an exposure unit 30 to form electrostatic latent images on photoconductors 21K, 21C, 21M and 21Y (e.g., photoconductors for black ('K'), cyan ('C'), magenta ('M'), and yellow ('Y'), respectively) of the developing units 20K, 20C, 20M and 20Y (e.g., developing units for black ('K'), cyan ('C'), magenta ('M'), and yellow ('Y'), respectively), a transfer device 40 to transfer visible images formed on the photoconductors 21K, 21C, 21M and 21Y to a printing medium S, a fusing unit 50 to fuse developer transferred to the printing medium S, a printing medium supply unit 60 to supply the printing medium S to the transfer device 40, and a printing medium discharge unit 70 to discharge the printing medium S, on to which an image has been formed, to the outside of the body 10.

The exposure unit 30 can irradiate light containing image information to the photoconductors 21K, 21C, 21M and 21Y to form electrostatic latent images on surfaces of the photoconductors 21K, 21C, 21M and 21Y.

The transfer device 40 can include an intermediate transfer belt 41 to receive the visible images from the respective photoconductors 21K, 21C, 21M and 21Y. The transfer device 40 can include first transfer rollers 42 can be arranged to face the photoconductors 21K, 21C, 21M and 21Y with the intermediate transfer belt 41 interposed therebetween to transfer the visible images from the photoconductors 21K, 21C, 21M and 21Y to the intermediate transfer belt 41. The transfer device 40 can include a second transfer roller 43 to transfer the visible images from the intermediate transfer belt 41 to the printing medium S. The visible images formed on the photoconductors 21K, 21C, 21M and 21Y can be transferred to the intermediate transfer belt 41 by the first transfer rollers 42. The visible images on the intermediate transfer belt 41 can be transferred to the printing medium S supplied from the printing medium supply unit 60 when the printing medium S passes between the second transfer roller 43 and the intermediate transfer belt 41.

The fusing unit 50 can include a heating roller 51 to generate heat, and a press roller 52 having an outer surface of an elastically deformable material to contact an outer surface of the heating roller 51.

The printing medium supply unit 60 can include at least one printing medium cassette 61 that can be forwardly and/or rearwardly movably mounted in the body 10, a knock-up plate 62 received in the printing medium cassette 61, on which printing media S is placed, a pickup roller 63 to pick up the printing media S stored in the printing medium cassette 61 sheet by sheet, and feed rollers 64 to feed the picked-up printing media S toward the transfer device 40.

The printing medium discharge unit 70 can include discharge rollers 71 arranged in sequence to discharge the printing medium S, on which developer fusion has been completed when passing through the fusing unit 50, to the outside of the body 10.

Figure 2:
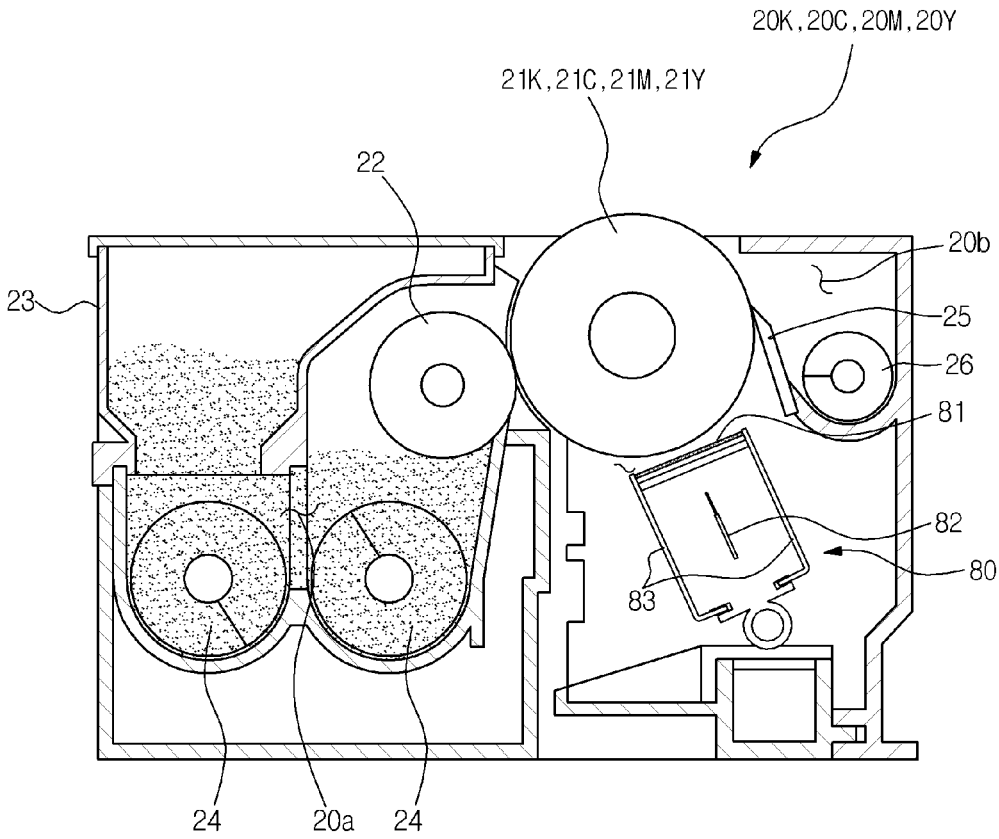
FIG. 2 illustrates a sectional view of a developing unit included in the image forming apparatus according to exemplary embodiments of the present general inventive concept.

As illustrated in FIG. 2, the developing units 20K, 20C, 20M and 20Y can be image carriers containing developer images. Each of the developing units 20K, 20C, 20M and 20Y can include the photoconductor 21K, 21C, 21M or 21Y on the surface of which an electrostatic latent image can be formed, a developing member 22 to develop the electrostatic latent image of the photoconductor 21K, 21C, 21M or 21Y into a visible image by attaching developer to the photoconductor 21K, 21C, 21M or 21Y, and a charge device 80 to charge the surface of the photoconductor 21K, 21C, 21M or 21Y with a predetermined potential before the exposure unit 30 forms the electrostatic latent image on the surface of the photoconductor 21K, 21C, 21M or 21Y.

The developing unit 20K, 20C, 20M or 20Y can include a developing unit case 23 to support a developer receiving chamber 20*a* to store developer and a waste developer collecting chamber 20*b* to collect developer remaining on the photoconductor 21K, 21C, 21M or 21Y. A pair of developer agitators 24 can be arranged in the developer receiving chamber 20*a* to agitate the developer stored in the developer receiving chamber 20*a*. The waste developer collecting chamber 20*b* can include a cleaning blade 25, a tip end of which is supported on the outer circumference of the photoconductor 21K, 21C, 21M or 21Y, the cleaning blade 25 to collect waste developer remaining on the photoconductor 21K, 21C, 21M or 21Y in the waste developer collecting chamber 20*b*. The waste developer collecting chamber 20*b* can receive a waste developer agitator 26 to agitate the waste developer.

The charge device 80 can include a first electrode 81, a first surface of which can be arranged to face the photoconductor 21K, 21C, 21 M or 21Y to be charged, and a second electrode 82 spaced apart from an opposite second surface of the first electrode 81. The first electrode 81 and the second electrode 82 can perform corona discharge therebetween. A tip end of the second electrode 82 can be spaced apart from the first electrode 81. In exemplary embodiments of the present general inventive concept, the first electrode 81 can be a lattice-shaped electrode, and the second electrode 82 can be a pin-shaped electrode, a tip end of which can be pointed to face the first electrode 81. A shield 83 can surround the second electrode 82. In this case, to provide corona discharge, a voltage of −400V to about −700V can be applied to the first electrode 81 and a voltage of 0V to about −5 kV can be applied to the second electrode 82. Also, a voltage having a difference of about 0V to 100V from the voltage applied to the first electrode 81 can be applied to the shield 83.

A voltage source (not illustrated) can be connected to the first electrode 81 and the second electrode 82 through an electrical connection line (not illustrated). The second electrode 82 can include a body extended from the tip end to be supported by a housing which includes the shield 83. The second electrode 82 can be space apart from the sides of the shield 83.

Figure 3:
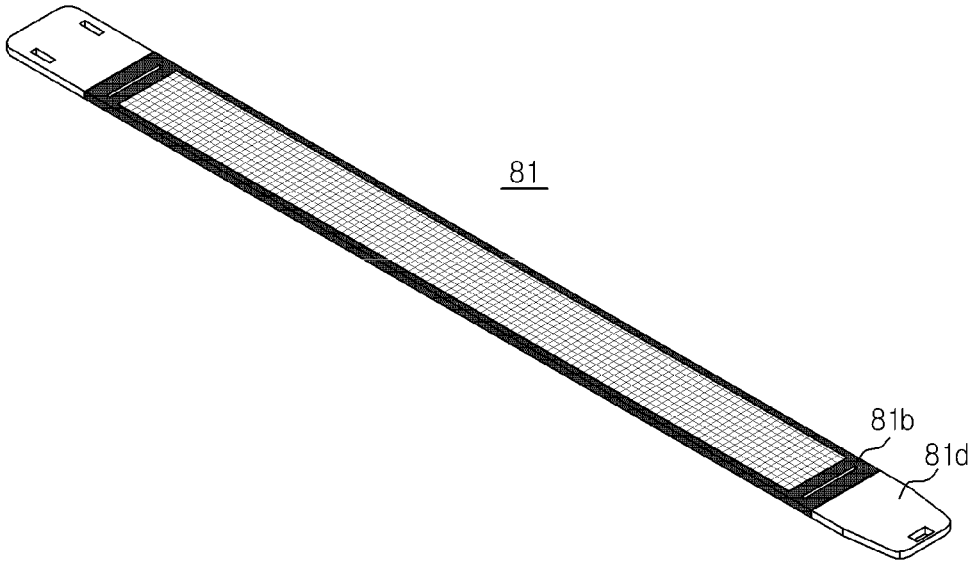
FIG. 3 illustrates a perspective view of a first electrode included in the image forming apparatus according to exemplary embodiments of the present general inventive concept.
Figure 4:
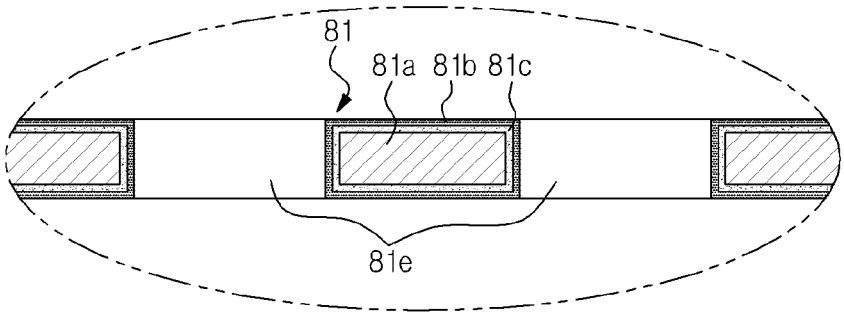
FIG. 4 illustrates a partial sectional view of the first electrode included in the image forming apparatus according to exemplary embodiments of the present general inventive concept.

The first electrode 81, as illustrated in FIGS. 3 and 4, can include an electrode body 81*a* made of a conductive material (e.g., a metal such as stainless steel), and a first layer 81*b* made of carbon and formed on an outer surface of the electrode body 81*a* to reduce oxidization of the electrode body 81*a*. As illustrated in the partial sectional view of FIG. 4 and discussed in detail below, a second layer 81*c* may be disposed between the electrode body 81*a* and the first layer 81*b*. The first electrode 81 having the electrode body 81*a*, first layer 81*b*, and second layer 81*c* may be disposed in and/or attached to a case 81*d*.

A carbon film forming the first layer 81*b* may be any one of a hydrogenated amorphous carbon film made of SP2-bonded carbon, a hard carbon film made of SP3-bonded carbon, and a Diamond like Carbon (DLC) film made of a mixture of SP2-bonded carbon and SP3-bonded carbon. A hydrogenated amorphous carbon film having a hydrogen content of 10~45 atm %, or a DLC film can be used. When the first layer 81*b* is formed of the hydrogenated amorphous carbon film having a hydrogen content of 10~45 atm %, the first layer 81*b* can have a Vickers hardness of 2000~5000 kg/mm2, electric resistance of 1080 or more (e.g., 100-200Ω, 200-400Ω, 400-1000Ω, etc.), thermal conductivity of 200 W/mk or more (e.g., 200-400 W/mk, 400-600 W/mk, 600-1000 W/mk, etc.), and a coefficient of friction of 0.2 or less (e.g., where the coefficient of friction approaches zero) according to the selected carbon film. That is, the first layer 81*b* can have increased hardness, thermal conductivity, and insulation performance.

The first layer 81*b* may be formed by a carbon film forming method, such as direct current plasma, radio frequency plasma, magnetic field, or laser plasma assisted chemical vapor deposition, ion beam sputtering, ion beam deposition, ion plating, reactive plasma sputtering, ion implantation, cathodic arc deposition, or any other suitable method to form the first layer 81*b* to carry out the exemplary embodiments of the present general inventive concept disclosed herein.

When the first layer 81*b* is made of carbon as described above, the first layer 81*b* can have fine pin holes that are typically formed during coating of a thin carbon film (e.g., a carbon film having a predetermined thickness). Although the pin holes can be microscopic, a substance, such as ozone, may directly react with the electrode body 81*a* through the pin holes. Therefore, byproducts of discharge, such as ozone transmitted through the pin holes, may oxidize and contaminate the electrode body 81*a*, and may separate the first layer 81*b* from the electrode body 81*a*.

As illustrated in FIG. 4, a second layer 81*c* may protect the electrode body 81*a* from discharge byproducts. The second layer 81*c* can be provided between the electrode body 81*a* and the first layer 81*b*. The second layer 81*c* can be made of a conductive metal similar to the electrode body 81*a*. In exemplary embodiments of the present general inventive concept, the second layer 81*c* can be made of chromium (Cr), titanium (Ti), tungsten (W), or the like, each of which can have increased corrosion resistance from stainless steel that can form the electrode body 81*a*.

As illustrated in the partial sectional view of FIG. 4, a plurality of electrodes that are similar to the first electrode 81 having the electrode body 81*a*, the first layer 81*b*, and the second layer 81*c* may be disposed adjacent to one another and may be spaced apart from one another by space 81*e*.

According to results of experiments to test effects of the first layer 81*b* and the second layer 81*b*, the image forming apparatus 100 can exhibit an image defect after image formation on about 10,000 printing media S if the first electrode 81 of the charge device 80 includes the electrode body 81*a* alone. Also, the experimental results illustrate that the image forming apparatus 100 does not exhibit an image defect after image formation on about 10,000 printing media S, but exhibits an image defect after image formation on about 20,000 printing media S if the first electrode 81 of the charge device 80 includes the electrode body 81*a* and the first layer 81*b* only, and that the image forming apparatus 100 does not exhibit an image defect even after image formation on about 20,000 printing media S if the first electrode 81 of the charge device 80 includes the electrode body 81*a*, the first layer 81*b* and the second layer 81*c*.

As will be appreciated from the above experimental results, the first layer 81*b* and the second layer 81*c* may extend and/or increase the lifespan of the first electrode 81, and thus, the charge device 80 may be used for a longer period of time without generation of image defects.

Exemplary embodiments of the present general inventive concept can include the first electrode 81 as having a lattice shape and the second electrode 82 as having a pin shape, but is not limited thereto, and various other electrode shapes to carry out the exemplary embodiments of the present general inventive concept may be used.

Although exemplary embodiments of the present general inventive concept detailed above describes an exemplary color image forming apparatus, the exemplary embodiments are not limited thereto, and may be directly applied to a charging device used in various other devices as well as an image forming apparatus to print a black-and-white image.

As is apparent from the above description, by forming a first layer of carbon on an outer surface of a lattice-shaped electrode, it may be possible to reduce and/or impede oxidization of an electrode body due to ozone or oxides generated during corona discharge.

When a second layer made of metal to protect the electrode body from discharge byproducts is provided between the electrode body and the first layer, the electrode body may have an extended and/or increased lifespan.

Although several embodiments of the present general inventive concept have been illustrated and described, it would be appreciated by those skilled in the art that changes may be made in these embodiments without departing from the principles and spirit of the general inventive concept, the scope of which is defined in the claims and their equivalents.

What is claimed is:

1. A charge device, comprising:

a lattice-shaped electrode arranged to face an object to be charged, wherein the lattice-shaped electrode includes an electrode body made of a conductive material, a first layer made of carbon and formed on an outer surface of the electrode body, and a second layer surrounding the electrode body, the second layer provided between the electrode body and the first layer.

2. The charge device according to claim 1, wherein the electrode body is made of stainless steel.

3. The charge device according to claim 1, wherein the second layer is made of a metal to protect the electrode body from discharge byproducts.

4. The charge device according to claim 1, wherein the second layer is made of any one of chromium, titanium, and tungsten.

5. A charge device, comprising:

a first electrode having a first surface arranged to face an object to be charged; and a second electrode spaced apart from an opposite second surface of the first electrode, wherein the first electrode includes an electrode body made of a conductive material, a first layer made of carbon and formed on an outer surface of the electrode body, and a second layer surrounding the electrode body, the second layer provided between the electrode body and the first layer.

6. The charge device according to claim 5, wherein the electrode body is made of stainless steel.

7. The charge device according to claim 5, wherein the first electrode includes a lattice-shaped electrode.

8. The charge device according to claim 5, wherein the second electrode includes a pin-shaped electrode having a pointed end.

9. The charge device according to claim 5, wherein the second layer is made of a metal to protect the electrode body from discharge byproducts.

10. The charge device according to claim 5, wherein the second layer is made of any one of chromium, titanium, and tungsten.

11. An image forming apparatus comprising:

a photoconductor; and a charge device to charge the photoconductor, wherein the charge device includes a first electrode having a first surface arranged to face with the photoconductor, and a second electrode spaced apart from an opposite second surface of the first electrode, and wherein the first electrode includes an electrode body made of a conductive material, a first layer made of carbon and formed on an outer surface of the electrode body, and a second layer surrounding the electrode body, the second layer provided between the electrode body and the first layer.

12. The image forming apparatus according to claim 11, wherein the electrode body is made of stainless steel.

13. The image forming apparatus according to claim 11, wherein the first electrode includes a lattice-shaped electrode.

14. The image forming apparatus according to claim 11, wherein the second electrode includes a pin-shaped electrode having a pointed end.

15. The image forming apparatus according to claim 11, wherein the second layer is made of a metal to protect the electrode body from discharge byproducts.

16. The image forming apparatus according to claim 15, wherein the second layer is made of any one of chromium, titanium, and tungsten.

17. A developing unit of an image forming apparatus to form developer images onto an imaging medium, comprising:

a photoconductor having a surface on which an electrostatic latent image is formed;

a developing member to develop the electrostatic latent image on the photoconductor into a visible image with developer; and a charge device to charge the surface of the photoconductor with a predetermined potential before an exposure unit forms the electrostatic latent image on the surface of the photoconductor, the charge device having a first electrode with a first surface arranged to face the photoconductor, and a second electrode spaced apart from an opposite second surface of the first electrode, wherein the first electrode includes:

an electrode body made of a conductive material;

a first layer made of carbon and formed on an outer surface of the electrode body; and a second layer surrounding the electrode body, the second layer provided between the electrode body and the first layer.

18. The developing unit of claim 17, wherein the second layer has a greater corrosion resistance than the electrode body.

19. A charge device, comprising:

an electrode arranged to face an object to be charged, the electrode having:

an electrode body formed a conductive material;

a first layer disposed on a surface of the electrode body so as to surround the electrode body; and a second layer made of carbon disposed on a surface of the first layer.

20. The charge device of claim 19, wherein the electrode body comprises stainless steel.

21. The charge device of claim 19, wherein the second layer is a metal to protect the electrode body from discharge byproducts.

22. The charge device of claim 19, wherein the second layer comprises one of chromium, titanium, and tungsten.

* * * * *